US007765634B2

(12) United States Patent
Akinfiev et al.

(10) Patent No.: US 7,765,634 B2
(45) Date of Patent: Aug. 3, 2010

(54) SURFACE-CLEANING MACHINE

(75) Inventors: Teodor Akinfiev, Madrid (ES); Manuel Angel Armada Rodriguez, Madrid (ES)

(73) Assignee: Consejo Superior de Investigaciones Cientificas, Madrid (ES)

( * ) Notice: Subject to any disclaimer, the term of this patent is extended or adjusted under 35 U.S.C. 154(b) by 1009 days.

(21) Appl. No.: 10/515,588

(22) PCT Filed: May 9, 2003

(86) PCT No.: PCT/ES03/00208

§ 371 (c)(1),
(2), (4) Date: Jul. 22, 2005

(87) PCT Pub. No.: WO03/100192

PCT Pub. Date: Dec. 4, 2003

(65) Prior Publication Data

US 2006/0021167 A1 Feb. 2, 2006

(30) Foreign Application Priority Data

May 24, 2002 (ES) ..... P200201199

(51) Int. Cl.
*A47L 1/02* (2006.01)
*B08B 1/04* (2006.01)

(52) U.S. Cl. ..... 15/301; 15/52.1; 15/103

(58) Field of Classification Search ..... 15/49.1, 15/50.1, 50.3, 52.1, 88.4, 98, 103, 301, 302
See application file for complete search history.

(56) References Cited

U.S. PATENT DOCUMENTS

| | | | | |
|---|---|---|---|---|
| 3,641,607 | A * | 2/1972 | Lemelson | 15/4 |
| 3,831,848 | A * | 8/1974 | Cook | 239/104 |
| 4,025,984 | A * | 5/1977 | Hoener, Jr. | 15/302 |
| 4,351,132 | A * | 9/1982 | Molin | 451/354 |
| 5,240,503 | A * | 8/1993 | Levy et al. | 118/323 |
| 5,249,326 | A * | 10/1993 | Jefferies et al. | 15/50.1 |
| 6,370,728 | B1 * | 4/2002 | Burns | 15/320 |

FOREIGN PATENT DOCUMENTS

| | | | |
|---|---|---|---|
| FR | 2654652 | * | 5/1991 |
| GB | 1165082 | * | 9/1969 |
| JP | 6-90885 | * | 4/1994 |
| JP | 8-10190 | * | 1/1996 |
| JP | 8-150379 | * | 6/1996 |
| JP | 9-66265 | * | 3/1997 |

* cited by examiner

*Primary Examiner*—Mark Spisich
(74) *Attorney, Agent, or Firm*—Ladas and Parry LLP

(57) ABSTRACT

Machine for cleaning mainly vertical surfaces comprising a body attached to the cable of the crane, brushes with an actuator attached to the body with the possibility of rotation, three or more wheels attached to the body with the possibility of rotation, and the attachment being such that their working components are in the same plane, and distinguished in that it comprises a box with an open wall on the side of the treated surface, with an elastic seal around the perimeter of the open part of the box and means to extract air from the box.

12 Claims, 6 Drawing Sheets

SURFACE-CLEANING MACHINE

SECTOR OF THE ART

Figure 1:
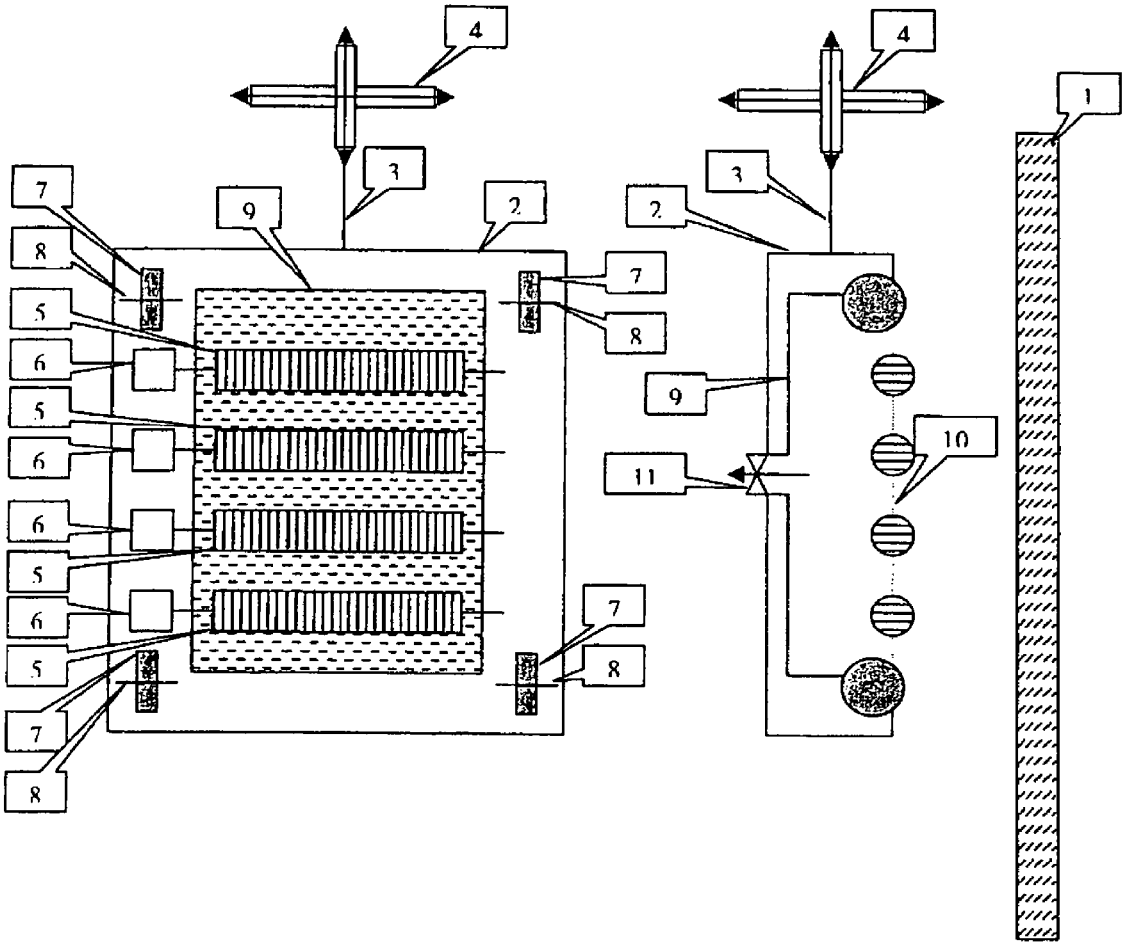

This invention relates to the field of automation, and more specifically processes for the cleaning and maintenance of surfaces, particularly in buildings.

STATE OF THE ART

Various technical devices which can be used to clean surfaces, mainly vertical surfaces, are known (1-3). In the known solutions in the art a device for the cleaning of surfaces such as a body with brushes or other components for the spraying of liquids is described.

The defect in the known technical solutions (1-3) is that their technological possibilities are inadequate. This is manifested by the fact that no uniform distance is maintained between the cleaning elements and the surface being treated when these devices are in use. This gives rise to defective and low quality cleaning, which brings about an abrasive wearing action on the surface in some areas and insufficient cleaning in others. Furthermore, the failure to maintain a uniform distance between the devices and the surface being treated causes significant oscillation in the said devices, causing damage to the surface and increasing the risk of accidents.

1. Patent 08150379 A, Japan.
Harada Mamoru.
Device for washing and cleaning wall surface of building.
2. U.S. Pat. No. 4,351,132, USA
Roland Morin.
Machine for cleaning vertical or inclined surfaces.
3. Patent FR 2654652-A1, France.
Means for automatically cleaning smooth walls and in particular the glazing of buildings.

DESCRIPTION OF THE INVENTION

Brief Description of the Invention

Machine for the cleaning of surfaces, mainly vertical surfaces, which comprises a body attached to the cable of a crane, brushes with an actuator attached within the body with the possibility of rotation, three or more wheels attached to the body with the possibility of rotation, this attachment being such that the working components are in the same plane, and which is characterized in that it contains a box with an open wall on the side of the surface treated, an elastic seal around the perimeter of the open part of the box and means to extract air from the box.

Detailed Description of the Invention

The object of the invention is to improve the process of cleaning and maintaining the surfaces requiring treatment as well as extracting air from the box while it is in operation. Together with the assistance of the elastic seal located around the open part of the box, this makes it possible to exert a pressure on the surface being treated so that more uniform contact is achieved between the brushes and the surface, thus improving the quality of the cleaning process.

In order to achieve the object of the invention the machine for cleaning surfaces comprises a body attached to the cable of a crane, brushes with one or more actuators attached on the body with the possibility of rotation and three or more wheels attached to the body with the possibility of rotation. The attachment is such that the working components are in the same plane and it is distinguished in that it comprises a box with an open wall on the side of the treated surface, an elastic seal around the perimeter of the open part of the box and means to extract air from the box.

The point at which the cable is attached to the body of the machine is chosen in such a way that when the wheels bear against the vertical flat surface being treated the distance from the point of attachment of the cable to the treated surface is equal to the distance from the centre of gravity of the machine to the treated surface.

The air extraction means are constructed in the form of a fan with an actuator attached within the body. The fan may comprise a filter for the air extracted from the box.

The cross-section of the elastic seal is of curvilinear shape with one extremity attached to the walls of the box and the other extremity located outside the box. With this configuration, when the wheels bear against the flat surface being cleaned the elastic seal also bears partly against that surface, with a length of the same parallel to the surface.

The wheels of the device are constructed so that they can rotate through at least 90° as a result of a special actuator. This actuator also ensures simultaneous rotation through the same angle. Some of the wheels may include means to clean the working surface of the wheels. Sensors may also be provided to measure the angle of rotation so that the position of the robot can be calculated.

The box includes an aperture which connects to the atmosphere and a valve is fitted in this opening to open the aperture when there is a pressure difference between the atmosphere and the space within the box which exceeds a predetermined value P1, and which closes this aperture when the difference is less than a predetermined value P2.

Within the box there are one or more additional wheels, and these additional wheels are located in such a way that when the main wheels bear on the flat surface being treated and there is no difference in pressure between the atmosphere and the space within the box the distance between the additional wheels and the treated surface has a predetermined value $L_i$, where i is the number of the additional wheel. The system for attaching the additional wheels is provided in such a way that it allows these wheels to rotate freely.

The cleaning machine may comprise one or more tubes attached to the box. One end of these tubes opens to atmosphere and the other end is inserted into the box and ends close to the surface treated.

The machine may be supplemented by a system which sprays a product which improves the technological process (for example a liquid) onto the surface 1 being treated.

The machine may be supplemented by a system which causes a product which improves the technological process (for example a liquid) to come into contact with brushes 5.

Process of Operation

The device is operated in the following way. In the initial position body 2 of the machine is fixed to cable 3 of crane 4 and at some distance from surface 1 requiring treatment (for example supported on the ground at a distance from the vertical surface). With the assistance of crane 4 the machine is raised (if for example it was supported on the ground) and approaches surface 1 requiring treatment. Once the elastic seal 10 surrounding the open part of box 9 comes into contact with surface 1 requiring treatment or is close thereto the means to extract air 11 from box 9 are activated. When air is extracted from box 9 a force is provided which attracts body 2 against surface 1 until the wheels 7 which have the possibility of rotating 8 (which are attached to body 2 in such a way that their working components are in the same plane) come into contact with surface 1. In this position brushes 5 come into contact with surface 1 requiring treatment, with a predetermined deformation.

Brushes 5 which are capable of rotating are driven by actuators 6 and interact with surface 1 requiring treatment, carrying out the technological process of cleaning and maintaining surface 1. While the technological cleaning and maintenance process is being carried out by brushes 5, the means to extract air 11 from box 9 are in operation. After a certain help of a delay), body 2 of the machine moves (for predetermined time (calculated for example with the example upwards or downwards) with the help of cable 3 which connects it to crane 4. During this movement means 11 for extracting air from box 9 are in operation. In this way wheels 7 which are capable of rotation 8 (which are attached to body 2 in such a way that their working components are in the same plane) bear against surface 1 requiring treatment and rotate upon the same assisting its movement.

While the technological cleaning and maintenance process is being performed, the force of attraction produced by means 11 for extracting air from box 9 keep wheels 7 in contact with surface 1 requiring treatment, preventing body 2 of the machine from separating from surface 1 and ensuring a uniform contact distance between brushes 5 and surface 1.

After the technological process of cleaning and maintaining surface 1 requiring treatment has been performed, body 2 of the machine may be moved horizontally (to the right or to the left) through vertical upward or downward movements with the help of cable 3 linking body 2 to crane 4. To allow this horizontal movement wheels 7 may include a special actuator which allows them to rotate through at least 90° and can reduce the force of attraction provided by means 11 for extracting air from the box.

DETAILED DESCRIPTION OF THE DRAWINGS (AS APPROPRIATE)

Figure 2:
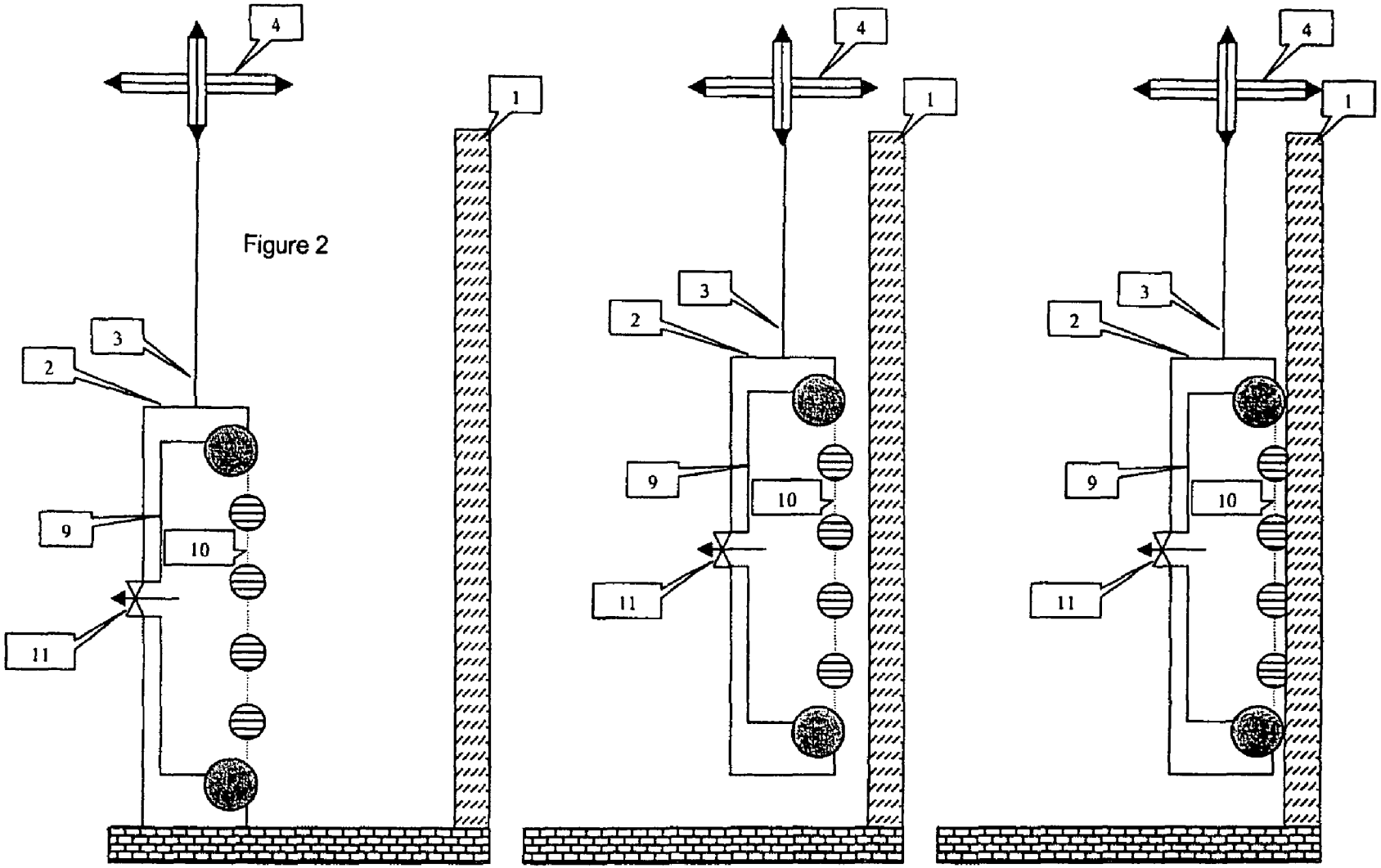
Figure 3:
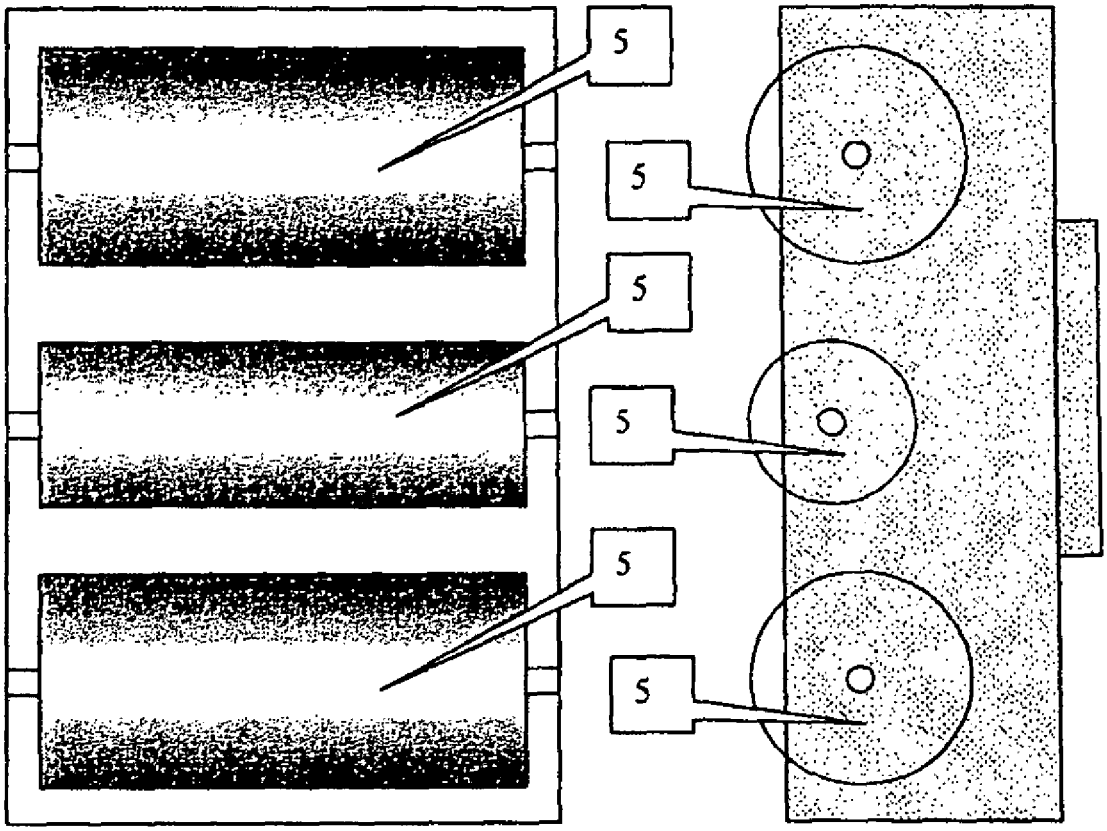
Figure 4:
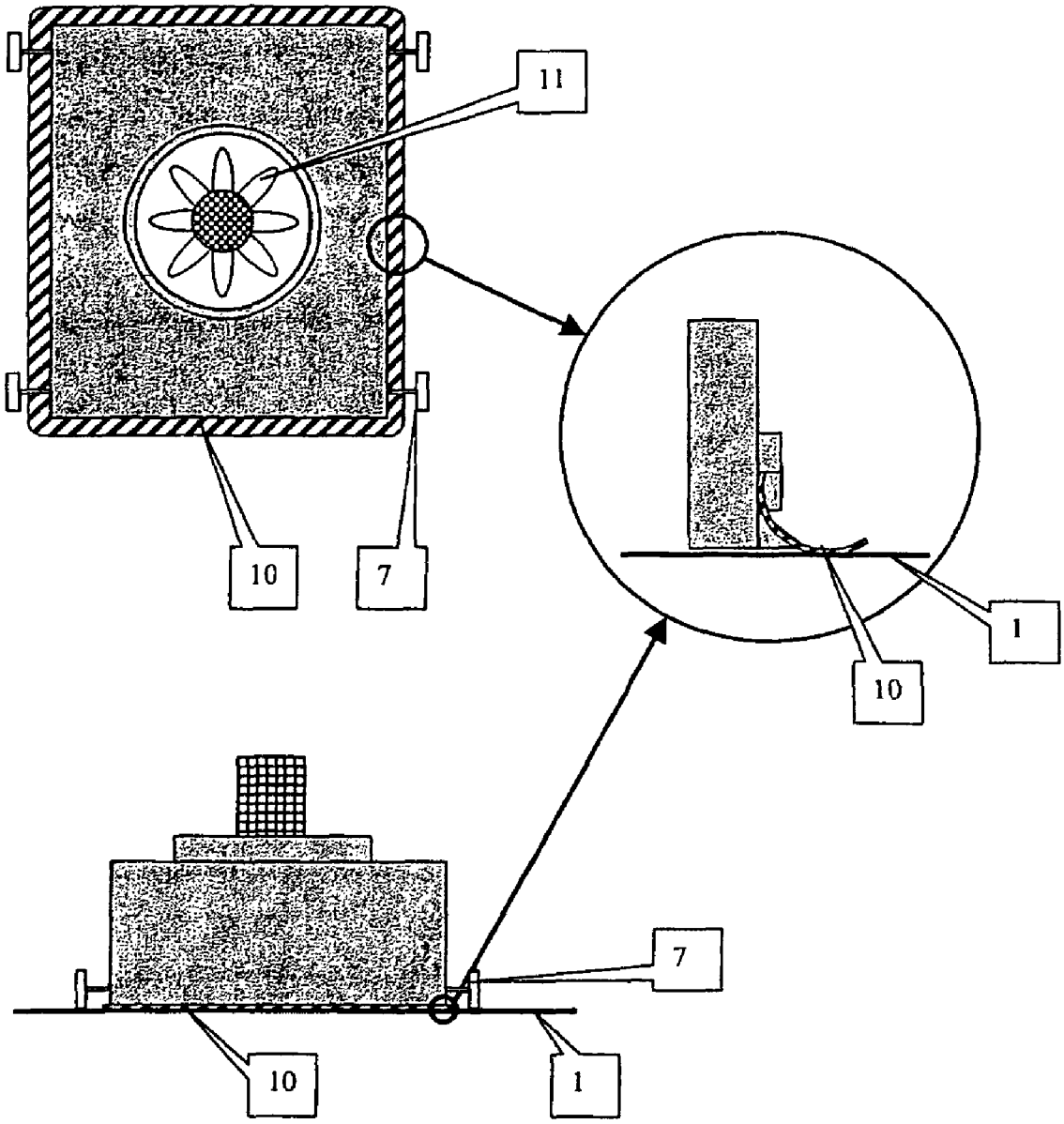
Figure 5:
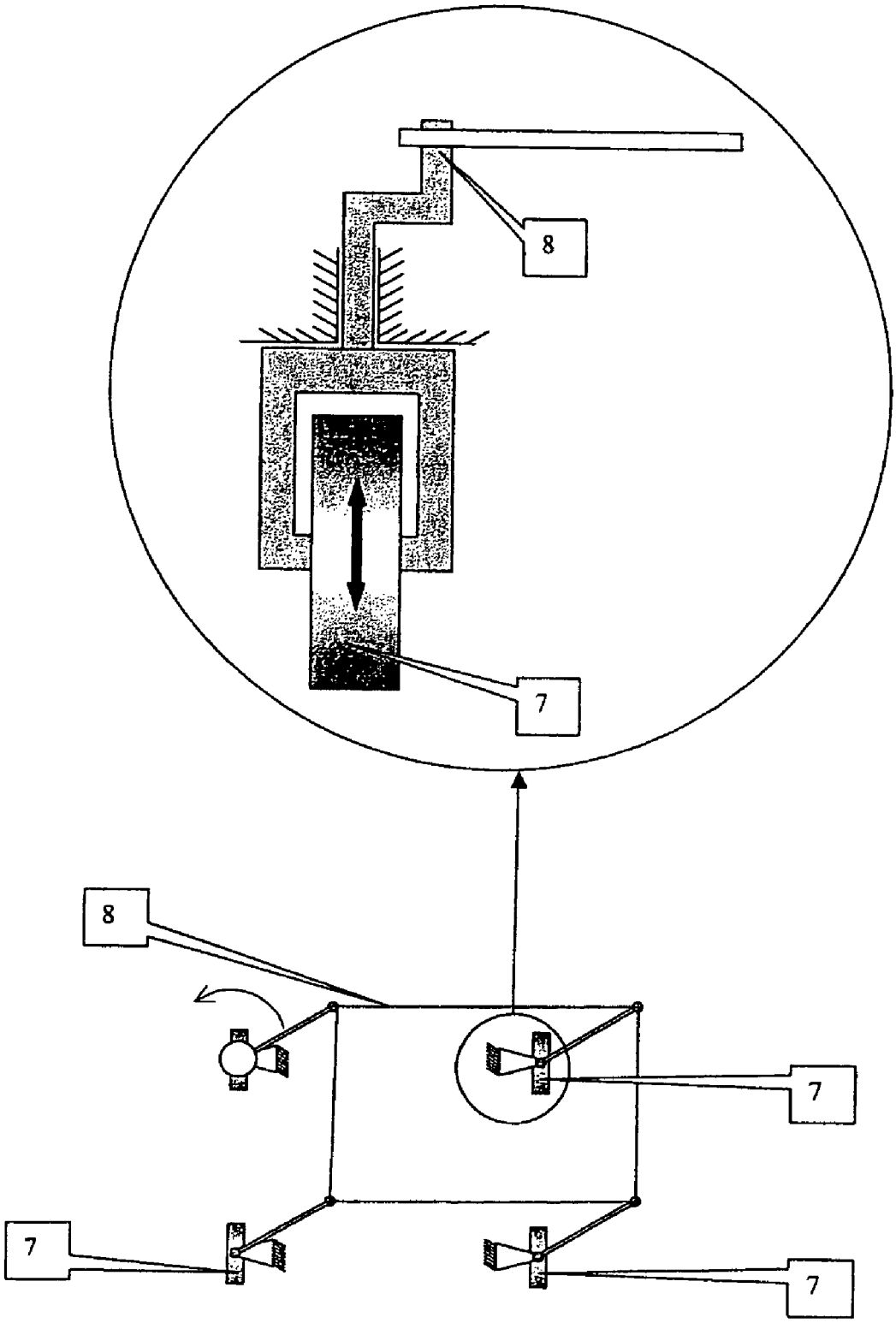
Figure 6:
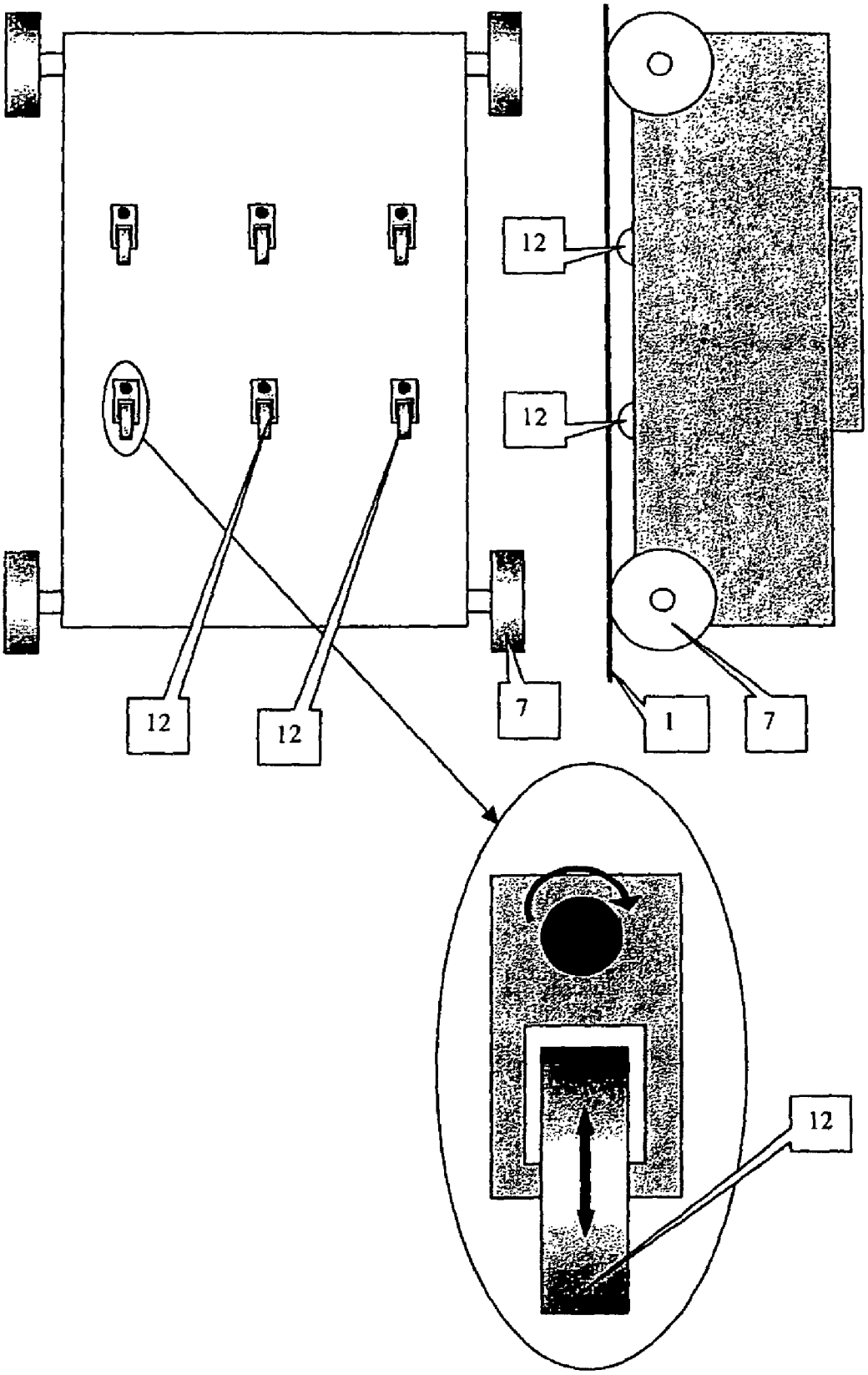

The invention is described in detail below through an example and making reference to the appended figures, FIG. 1. Machine for the cleaning of surfaces.
FIG. 2. Start of the operating process.
FIG. 3. The brushes.
FIG. 4. The elastic seal.
FIG. 5. Actuator for rotation of the wheels.
FIG. 6. Additional wheels.
1. The surface requiring treatment.
2. The body of the machine
3. The crane cable
4. The crane
5. The brushes
6. The actuator for the brushes
7. The wheels
8. The possibility for rotation of the wheels
9. The box with the open wall on the side of the surface treated
10. The elastic seal
11. Means for the extraction of air
12. Additional wheels

EXAMPLE EMBODIMENT OF THE INVENTION

The machine for the cleaning of vertical surfaces comprises the body attached to the cable of the crane, brushes attached to the body and with an actuator which enables them to rotate, four wheels attached to the body with the possibility of rotation. The attachment is such that the working components of the same are in the same plane and it is distinguished in that it comprises a box with an open wall on the side of the treated surface, with an elastic seal around the perimeter of the open part of the box and means for extracting air from the box. These means are constructed in the form of a fan with an actuator fixed within the body and with a filter for the air extracted from the box.

The point of attachment of the cable to the body of the machine is chosen in such a way that when the wheels bear against the flat vertical surface treated the distance between the point at which the cable is attached and the treated surface is the same as the distance between the centre of gravity of the machine and the surface treated.

The elastic seal has a cross-section of curvilinear shape, with one extremity fixed to the walls of the box and the other extremity located outside the box. With this configuration, when the wheels bear against the flat surface requiring cleaning the elastic seal also partly bears against that surface with a length of the same parallel to the surface.

The wheels of the device are constructed in such a way that they can rotate through 90° as a result of a special actuator. This actuator also ensures simultaneous rotation through the same angle.

Within the box there are six additional wheels which rotate freely and which are positioned in such a way that when the main wheels bear against the flat surface being treated and there is no difference in pressure between the atmosphere and the space within the box the distance between the additional wheels and the surface treated is 2 mm.

There are also three brushes within the box. The central brush is marked by the fact that it has a smaller diameter than the other two.

The invention claimed is:

1. A surface cleaning machine attachable to a cable of a crane for cleaning a surface, comprising:

a body attachable to the cable of the crane; the body comprising a box including walls and defining an open side for facing the surface to be cleaned, an elastic seal around a perimeter of the open side of the box, and a device for extracting air from the box;

brushes rotatably attached to the body;

one or more brush actuators connected to the brushes;

three or more main wheels rotatably attached to the body for bearing against the surface to be cleaned; and one or more additional wheels rotatably attached to the body, the additional wheels being positioned within the box of the body such that, when the main wheels bear against the surface to be cleaned and there is no pressure difference between an atmospheric pressure and a pressure inside the box of the body, the additional wheels are spaced from the surface;

wherein the brushes and the main wheels are configured to define a flat plane for cleaning the surface during operation.

2. A surface cleaning machine according to claim 1, wherein the elastic seal has a cross-section of a curvilinear shape, with one extremity attached to the walls of the box and the other extremity located outside the box such that when the wheels bear against the surface to be cleaned, the elastic seal also partly bears against the surface.

3. A surface cleaning machine according to claim 2, wherein the wheels of the device are constructed to rotate through at least 90° and include a special actuator.

4. A surface cleaning machine according to claim 1, wherein the wheels of the device are constructed to rotate through at least 90° and include a special actuator.

5. A surface cleaning machine according to claim 4, wherein the wheels include a device which ensures simultaneous rotation through the same angle.

6. A surface cleaning machine according to claim 1, wherein the body is attachable to the cable of the crane at a point of attachment such that when the wheels bear against the surface to be cleaned, a first distance between the point of attachment of the cable and the surface is equal to a second distance between a center of gravity of the machine and the surface.

7. A surface cleaning machine according to claim 1, wherein the additional wheels are configured to rotate freely.

8. A surface cleaning machine according to claim 1, wherein not all the brushes have the same rigidity.

9. A surface cleaning machine according to claim 1, wherein at least one part of the brushes is located within the box.

10. A surface cleaning machine according to claim 1, wherein the additional wheels are spaced from the surface at a distance of 2 mm.

11. A surface cleaning apparatus for cleaning a surface, the apparatus comprising:

a surface cleaning machine including:

a body comprising a box including walls and defining an open side for facing the surface to be cleaned, an elastic seal around a perimeter of the open side of the box, and a device for extracting air from the box;

brushes rotatably attached to the body;

one or more brush actuators connected to the brushes;

three or more main wheels rotatably attached to the body for bearing against the surface to be cleaned, the brushes and the main wheels are configured to define a flat plane for cleaning the surface during operation;

one or more additional wheels rotatably attached to the body, the additional wheels being positioned within the box of the body such that, when the main wheels bear against the surface to be cleaned and there is no pressure difference between an atmospheric pressure and a pressure inside the box of the body, the additional wheels are spaced from the surface;

a cable;

lifting means for lifting and lowering the surface cleaning machine with the cable;

wherein the body of the surface cleaning machine is attached to the cable at a point of attachment such that when the wheels bear against the surface to be cleaned, a first distance between the point of attachment of the cable and the surface is equal to a second distance between a center of gravity of the machine and the surface to provide a uniform contact between the brushes and the surface.

12. A surface cleaning apparatus according to claim 11, wherein the lifting means is a crane.

* * * * *